US009862568B2

(12) United States Patent
Piedra

(10) Patent No.: US 9,862,568 B2
(45) Date of Patent: Jan. 9, 2018

(54) ELEVATOR RUN PROFILE MODIFICATION FOR SMOOTH RESCUE

(71) Applicant: Otis Elevator Company, Farmington, CT (US)

(72) Inventor: Edward Piedra, Chicopee, MA (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 0 days.

(21) Appl. No.: 15/055,115

(22) Filed: Feb. 26, 2016

(65) Prior Publication Data

US 2017/0247223 A1 Aug. 31, 2017

(51) Int. Cl.
*B66B 3/00* (2006.01)
*B66B 1/30* (2006.01)

(52) U.S. Cl.
CPC ..... *B66B 1/30* (2013.01); *B66B 2201/34* (2013.01)

(58) Field of Classification Search
USPC ..... 187/247
See application file for complete search history.

(56) References Cited

U.S. PATENT DOCUMENTS 5,241,141 A 8/1993 Cominelli
5,637,841 A 6/1997 Dugan et al.
5,893,432 A 4/1999 Nguyen et al.
5,969,303 A 10/1999 Piserchia et al.
6,199,667 B1 * 3/2001 Fischgold ..... B66B 1/30 187/290
6,802,395 B1 10/2004 Helstrom et al.
7,434,664 B2 10/2008 Helstrom
7,637,353 B2 * 12/2009 Shibata ..... B66B 1/30 187/286
7,686,139 B2 3/2010 Kondo et al.
7,918,320 B2 4/2011 Kondo et al.
8,127,894 B2 * 3/2012 Agirman ..... B66B 1/308 187/290

(Continued)

FOREIGN PATENT DOCUMENTS

EP 2602221 A2 6/2013
WO 2011057464 A1 5/2011
WO 2015036650 A1 3/2015

OTHER PUBLICATIONS

Kone Corporation, "Kone N Minispace, Elevators with Small Machine Rooms" 2009, 12 pages.

(Continued)

*Primary Examiner* — Christopher Uhlir
(74) *Attorney, Agent, or Firm* — Cantor Colburn LLP

(57) ABSTRACT

A method of operating an elevator system is provided. The method includes powering, using a battery, the elevator system when an external power source is unavailable. The method also includes controlling, using a controller, a plurality of components of the elevator system. The controlling comprises operating at least one of the battery, an elevator car, a drive unit, and a brake. The method further includes determining, using the controller, a run profile of the elevator car in response to a selected deceleration. The method yet further includes operating, using the controller, the elevator car in response to the run profile determined, and determining, using the controller, an actual velocity of the elevator car.

6 Claims, 3 Drawing Sheets

(56) References Cited

U.S. PATENT DOCUMENTS

| | | | | |
|---|---|---|---|---|
| 8,297,411 | B2 * | 10/2012 | Hashimoto | B66B 1/285 187/288 |
| 8,584,808 | B2 | 11/2013 | Malrait et al. | |
| 8,789,660 | B2 | 7/2014 | Tenhunen | |
| 2012/0261217 | A1 | 10/2012 | Agirman et al. | |
| 2015/0144434 | A1 | 5/2015 | Herkel | |
| 2015/0353321 | A1 | 12/2015 | Fargo | |

OTHER PUBLICATIONS

European Search Report for application EP 17157791.9, dated Jul. 12, 2017, 8pgs.

* cited by examiner

ELEVATOR RUN PROFILE MODIFICATION FOR SMOOTH RESCUE

BACKGROUND

The subject matter disclosed herein relates generally to the field of elevator systems, and specifically to a method and apparatus for bringing an elevator to a controlled stop when power from an external power source is unavailable.

A typical elevator system includes a car and a counterweight disposed within a hoistway, a plurality of tension ropes that interconnect the car and counterweight, and a drive unit having a drive sheave engaged with the tension ropes to drive the car and the counterweight. The ropes, and thereby the car and counterweight, are driven by rotating the drive sheave. Traditionally, the drive unit and its associated equipment were housed in a separate machine room.

Newer elevator systems have eliminated the need for a separate machine room by mounting the drive unit in the hoistway. These elevator systems are referred to as machine room-less systems. Traditionally elevator systems have been dependent on an external power source for operation, which complicates operation in the event external power source is unavailable.

BRIEF SUMMARY

According to one embodiment, a method of operating an elevator system is provided. The method includes powering, using a battery, the elevator system when an external power source is unavailable. The method also includes controlling, using a controller, a plurality of components of the elevator system. The controlling comprises operating at least one of the battery, an elevator car, a drive unit, and a brake. The method further includes determining, using the controller, a run profile of the elevator car in response to a selected deceleration. The method yet further includes operating, using the controller, the elevator car in response to the run profile determined, and determining, using the controller, an actual velocity of the elevator car.

In addition to one or more of the features described above, or as an alternative, further embodiments of the method may include adjusting, using the controller, the run profile to match the actual velocity when the actual velocity is less than a selected velocity.

In addition to one or more of the features described above, or as an alternative, further embodiments of the method may include determining, using the controller, an actual electrical current of the drive unit when the actual velocity is not less than a selected velocity; and adjusting, using the controller, the run profile when the actual electrical current is above a selected electrical current.

In addition to one or more of the features described above, or as an alternative, further embodiments of the method may include determining, using the controller, an actual electrical current of the drive unit when the actual velocity is not less than a selected velocity; and maintaining, using the controller, the run profile when the actual electrical current is not above a selected electrical current.

In addition to one or more of the features described above, or as an alternative, further embodiments of the method may include determining, using the controller, a projected stop position and a velocity of the elevator car; and commanding, using the controller, the brake to stop the elevator car when the projected stop position is within a selected stop position range and the velocity is within a selected velocity range.

In addition to one or more of the features described above, or as an alternative, further embodiments of the method may include determining, using the controller, a projected stop position and a velocity of the elevator car; and determining, using the controller, an actual velocity of the elevator car when the projected stop position is not within a selected stop position range or the velocity is not within a selected velocity range.

According to another embodiment, an apparatus for operating an elevator system is provided. The apparatus includes a battery to power the elevator system when an external power source is unavailable, an elevator car, a drive unit, a brake, and a controller to control a plurality of components of the elevator system. The controlling comprises operating at least one of the battery, the elevator car, the drive unit, and the brake. The controller performs operations comprising: determining a run profile of the elevator car in response to a selected deceleration, operating the elevator car in response to the run profile determined, and determining an actual velocity of the elevator car.

In addition to one or more of the features described above, or as an alternative, further embodiments of the apparatus may include adjusting the run profile to match the actual velocity when the actual velocity is less than a selected velocity.

In addition to one or more of the features described above, or as an alternative, further embodiments of the apparatus may include determining an actual electrical current of the drive unit when the actual velocity is not less than a selected velocity; and adjusting the run profile when the actual electrical current is above a selected electrical current.

In addition to one or more of the features described above, or as an alternative, further embodiments of the apparatus may include determining an actual electrical current of the drive unit when the actual velocity is not less than a selected velocity; and maintaining the run profile when the actual electrical current is not above a selected electrical current.

In addition to one or more of the features described above, or as an alternative, further embodiments of the apparatus may include determining a projected stop position and a velocity of the elevator car; and commanding the brake to stop the elevator car when the projected stop position is within a selected stop position range and the velocity is within a selected velocity range.

In addition to one or more of the features described above, or as an alternative, further embodiments of the apparatus may include determining a projected stop position and a velocity of the elevator car; and determining an actual velocity of the elevator car when the projected stop position is not within a selected stop position range or the velocity is not within a selected velocity range.

Technical effects of embodiments of the present disclosure include an elevator system having a controller to bring an elevator car to a controlled stop when power from an external power source is unavailable. Further technical effects include that the controller avoids electrical current limit faults and velocity tracking faults, while determining an elevator run profile consistent with a selected deceleration rate.

The foregoing features and elements may be combined in various combinations without exclusivity, unless expressly indicated otherwise. These features and elements as well as the operation thereof will become more apparent in light of the following description and the accompanying drawings. It should be understood, however, that the following description and drawings are intended to be illustrative and explanatory in nature and non-limiting.

BRIEF DESCRIPTION OF THE DRAWINGS

The foregoing and other features, and advantages of the disclosure are apparent from the following detailed description taken in conjunction with the accompanying drawings in which like elements are numbered alike in the several FIGURES.

DETAILED DESCRIPTION

Figure 1:
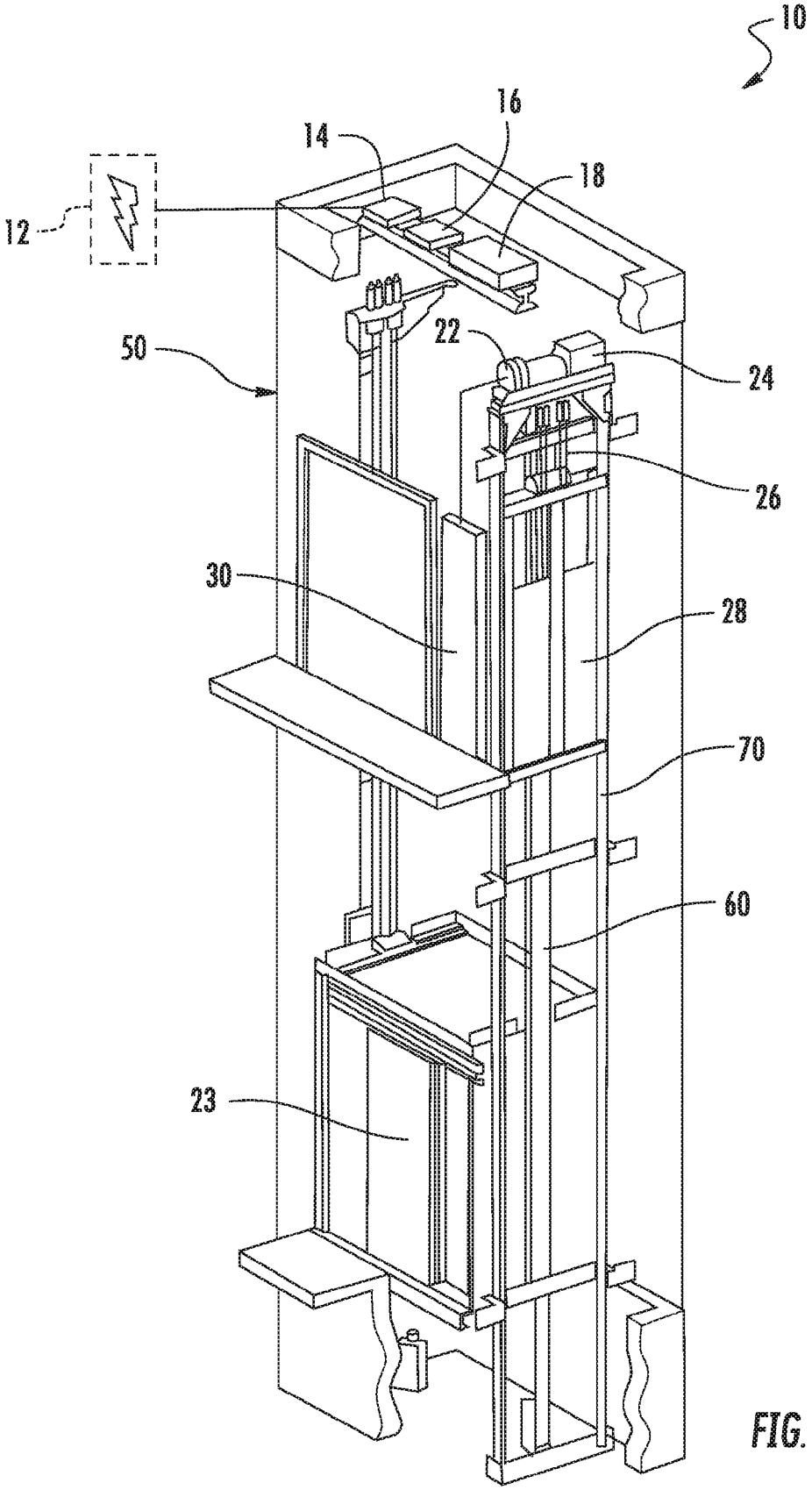
FIG. 1 illustrates a schematic view of an elevator system, in accordance with an embodiment of the disclosure.
Figure 2:
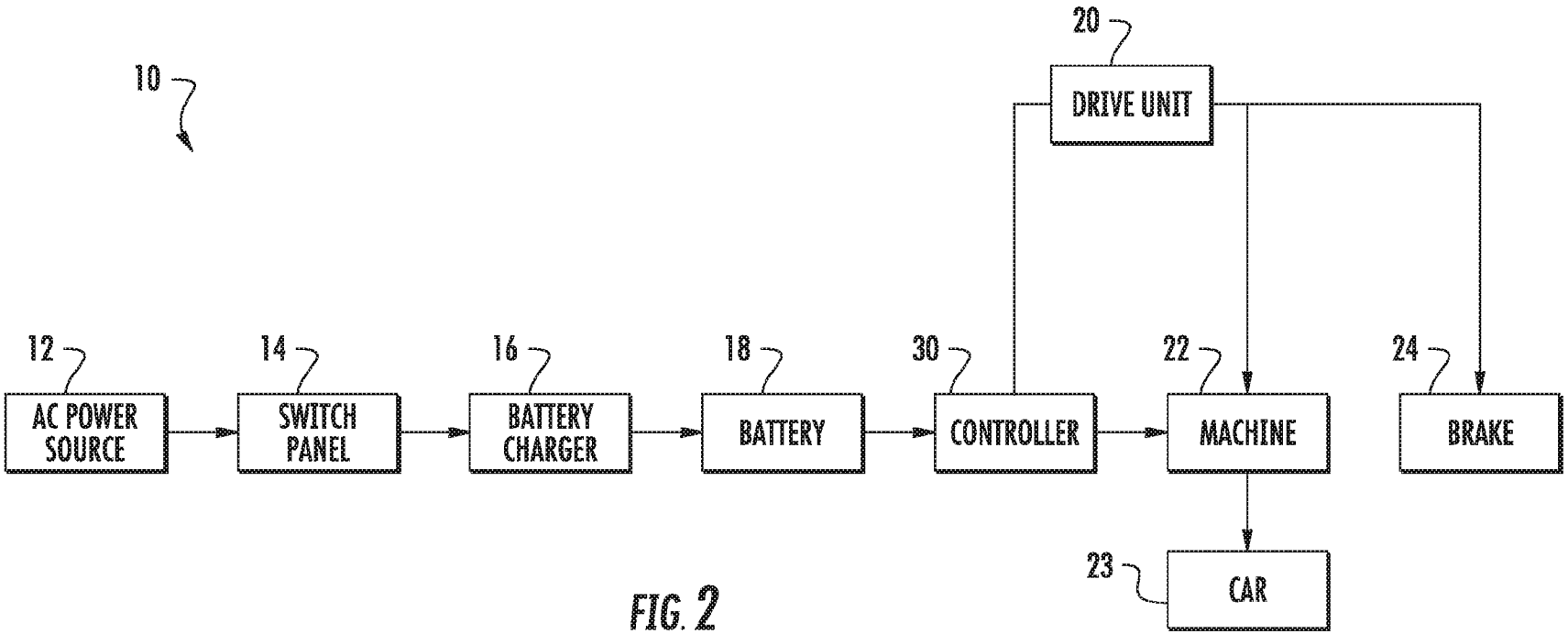
FIG. 2 is a block diagram of the elevator system of FIG. 1, in accordance with an embodiment of the disclosure.

Referring now to FIGS. 1 and 2. FIG. 1 shows a schematic view of an elevator system 10, in accordance with an embodiment of the disclosure. FIG. 2 shows a block diagram of the elevator system 10 of FIG. 1, in accordance with an embodiment of the disclosure. The elevator system 10 includes an elevator car 23 configured to move vertically upward and downward within a hoistway 50 along a plurality of car guide rails 60. The elevator system 10 also includes a counterweight 28 operably connected to the elevator car 23 via a pulley system 26. The counterweight 28 is configured to move vertically upward and downward within the hoistway 50. The counterweight 28 moves in a direction generally opposite the movement of the elevator car 23, as is known in conventional elevator systems. Movement of the counterweight 28 is guided by counterweight guide rails 70 mounted within the hoistway 50.

The elevator system 10 also includes an alternating current (AC) power source 12, such as an electrical main line (e.g., 230 volt, single phase). The AC power is provided from the AC power source 12 to a switch panel 14, which may include circuit breakers, meters, etc. From the switch panel 14, the AC power is provided to a battery charger 16, which converts the AC power to direct current (DC) power to charge a battery 18. The battery 18 may be a lead-acid, lithium ion or other type of battery. The battery 18 may power the elevator system 10 when an external power source (e.g. AC power source 12) is unavailable. The DC power flows through the controller 30 to a drive unit 20, which inverts the DC power from the battery 18 to AC drive signals. The drive unit 20 drives a machine 22 to impart motion to the elevator car 23 via a traction sheave of the machine 22. The AC drive signals may be multiphase (e.g., three-phase) drive signals for a three-phase motor in the machine 22. The machine 22 also includes a brake 24 that can be activated to stop the machine 22 and elevator car 23.

The drive unit 20 converts DC power from battery 18 to AC power for driving machine 22 in motoring mode. Motoring mode refers to situations where the machine 22 is drawing current from the drive unit 20. For example, motoring mode may occur when an empty elevator car is traveling downwards or a loaded elevator car is traveling upwards. The drive unit 20 also converts AC power from machine 22 to DC power for charging battery 18 when operating in regenerative mode. Regenerative mode refers to situations where the drive unit 20 receives current from the machine 22 (which acts as a generator) and supplies current back to the AC power source 12. For example, regenerative mode may occur when an empty elevator car is traveling upwards or when a loaded elevator car is traveling downwards. As will be appreciated by those of skill in the art, motoring mode and regenerative mode may occur in more than just the few examples described above and are within the scope of this disclosure.

The controller 30 is responsible for controlling the operation of the elevator system 10. The controller 30 may include a processor and an associated memory. The processor may be but is not limited to a single-processor or multi-processor system of any of a wide array of possible architectures, including field programmable gate array (FPGA), central processing unit (CPU), application specific integrated circuits (ASIC), digital signal processor (DSP) or graphics processing unit (GPU) hardware arranged homogenously or heterogeneously. The memory may be but is not limited to a random access memory (RAM), read only memory (ROM), or other electronic, optical, magnetic or any other computer readable medium.

In the event the external AC power source 12 is unavailable, the controller 30 is responsible for avoiding electrical current limit faults and velocity tracking faults, while determining a run profile consistent with a selected deceleration rate. The run profile may refer to the position, velocity, and/or acceleration of the elevator car 23 as it reaches a selected destination, which may be a safe location for rescue and/or egress from the elevator car 23. The run profile may be adjusted by actions including but not limited to changing the velocity of the drive unit 20, the rotational velocity of the traction sheave, or a combination comprising at least one of the foregoing. When calculating the correct run profile the controller 30 must factor in multiple variables including but not limited to the load, friction, imbalance, and other possible sources of variation. In the case of motoring runs, where the elevator car 23 stops faster than the dictated run profile due to gravity, the controller 30 adjusts the run profile to match the deceleration due to gravity. In the case of regenerative runs, the controller 30 dictates a run profile that would allow it to keep a balance between energy generated and energy being supplied back to the battery 18 and/or dissipated as heat (i.e. sinking). If the generated energy is more than the amount of energy (e.g. electrical current) that the drive unit 20 is capable of sinking, then the run profile would be adjusted in real time to lower the generated energy.

Advantageously, utilizing electrical current of the drive unit 20 and/or velocity of the elevator car 23 allows the controller 30 to adapt to hoistway loss variations, load weighing inaccuracies and load imbalance without needing a complex system model or complex parameterization to choose or predict the required deceleration rate to avoid electrical current limit faults or velocity tracking faults.

Figure 3:
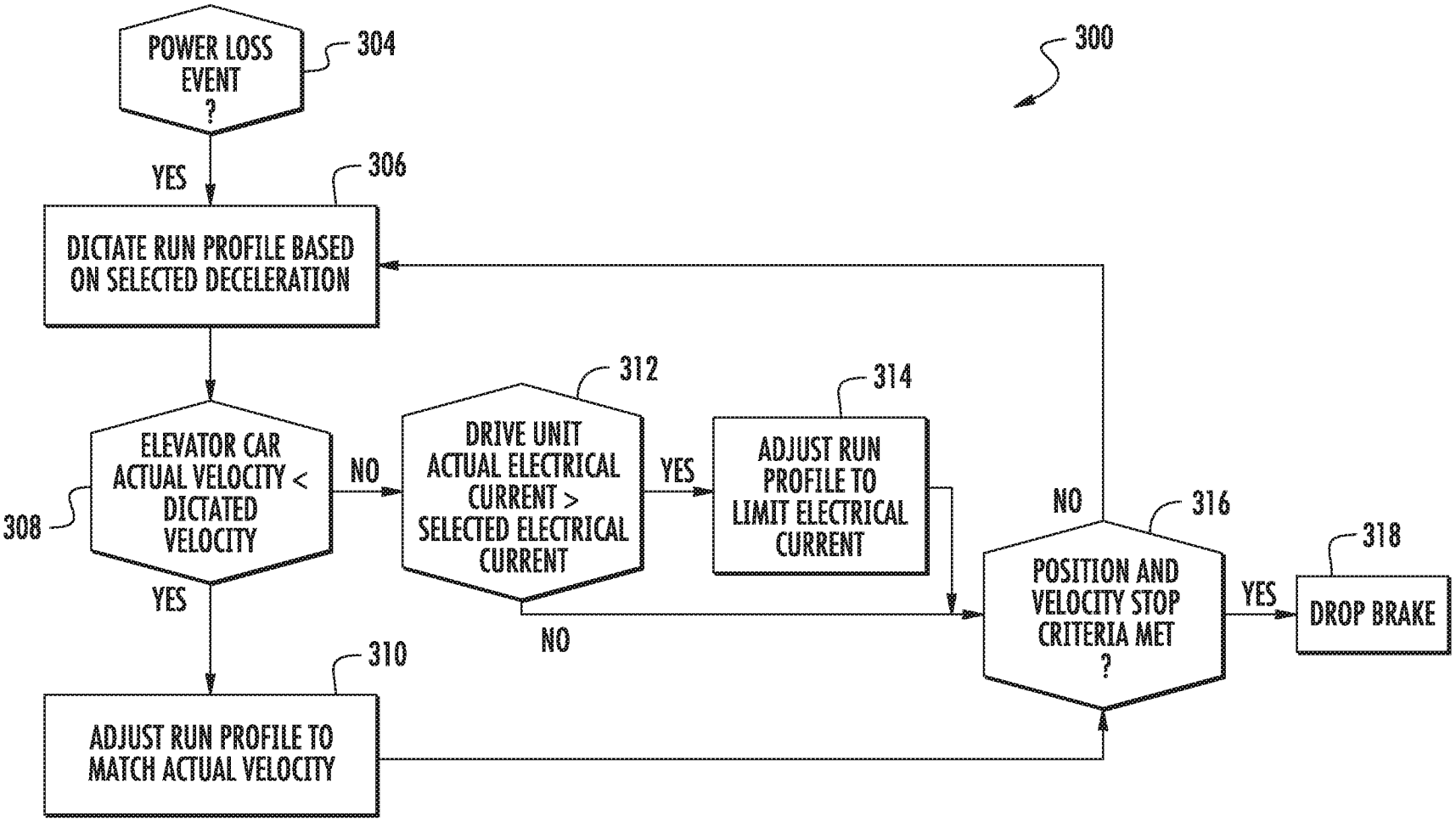
FIG. 3 is a block diagram of a smooth rescue software architecture of the elevator system of FIG. 1, in accordance with an embodiment of the disclosure.

Referring now also to FIG. 3, which shows a block diagram of a smooth rescue software 300 architecture of the elevator system 10 of FIG. 1, in accordance with an embodiment of the disclosure. The smooth rescue software 300 may be controlled by the controller 30 and may be responsible for bringing the elevator car 23 to a controlled stop in the event the external AC power source 12 is unavailable. The controller 30 utilizes the smooth rescue software 300 to avoid electrical current limit faults and velocity tracking faults, while determining a run profile consistent with a selected deceleration rate, as described above. The controller 30 may initiate the smooth rescue software 300 when a power loss event occurs at block 304. Once the power lost event has occurred, the smooth rescue software 300 may dictate a run profile based on a selected deceleration at block 306. The process of dictating a run profile may include determining a run profile and operating the elevator car in response to the run profile determined. In the event of power loss, the run profile dictates a certain speed and/or deceleration of the elevator car 23 to transition the elevator car 23 to a landing.

Next, the smooth rescue software 300 may determine the actual velocity of the elevator car 23 and compare the actual velocity to a selected velocity from the dictated run profile at block 308. If the actual velocity is determined to be less than the dictated velocity (i.e., motoring mode), then the smooth rescue software 300 may adjust the run profile to match the actual velocity at block 310. Then the smooth rescue software 300 may check whether the position and velocity stop criteria are met at bock 316, which is discussed later.

If the actual velocity is determined to not be less than the dictated velocity at block 308 (i.e., regenerative mode), then the smooth rescue software 300 may check whether the actual electrical current flowing into the drive unit 20 is above a selected electrical current at block 312. The selected electrical current may be a preset fault limit (e.g. of the drive unit 20). If the actual electrical current flowing into the drive unit 20 is above the selected electrical current at block 312, then the smooth rescue software 300 may adjust the run profile to limit the electrical current at block 314 and next check whether the position and velocity stop criteria are met at bock 316. Block 314 is used to reduce the amount of current being sunk into the machine 22 so that current sinking limits of the machine are not exceeded. This may be achieved by adjusting the run profile to reduce deceleration of the elevator car 23. If the actual electrical current flowing into the drive unit 20 is not above the selected electrical current at block 312, then the smooth rescue software 300 may maintain the run profile and check whether the position and velocity stop criteria are met at bock 316. The position and velocity stop criteria may include a selected stop position range and a selected velocity range of the elevator car 23. The position and velocity stop criteria may be met if a projected stop position is within the selected stop position range and a velocity of the elevator car 23 is within the selected velocity range. The velocity referred to is the velocity of the elevator car 23 as it approaches the projected stop position. If the velocity is too high, the elevator car may need to decelerate too fast to reach the projected stop position. At block 316, if the position and velocity stop criteria are met, then the smooth rescue software 300 may drop the brake 24 at block 318. If the position and velocity stop criteria are not met, then the smooth rescue software 300 may return back to block 306 to dictate the run profile based on a selected deceleration.

The terminology used herein is for the purpose of describing particular embodiments only and is not intended to be limiting. While the description has been presented for purposes of illustration and description, it is not intended to be exhaustive or limited to embodiments in the form disclosed. Many modifications, variations, alterations, substitutions or equivalent arrangement not hereto described will be apparent to those of ordinary skill in the art without departing from the scope of the disclosure. Additionally, while the various embodiments have been described, it is to be understood that aspects may include only some of the described embodiments. Accordingly, the disclosure is not to be seen as limited by the foregoing description, but is only limited by the scope of the appended claims.

What is claimed is:

1. A method of operating an elevator system, the method comprising:

powering, using a battery, the elevator system when an external power source is unavailable;

controlling, using a controller, a plurality of components of the elevator system, wherein controlling comprises operating at least one of the battery, an elevator car, a drive unit, and a brake;

determining, using the controller, a run profile of the elevator car in response to a selected deceleration;

operating, using the controller, the elevator car in response to the run profile determined;

determining, using the controller, an actual velocity of the elevator car; and adjusting, using the controller, the run profile to match the actual velocity when the actual velocity is less than a selected velocity.

2. The method of claim 1, further comprising:

determining, using the controller, a projected stop position and a velocity of the elevator car; and commanding, using the controller, the brake to stop the elevator car when the projected stop position is within a selected stop position range and the velocity is within a selected velocity range.

3. The method of claim 1, further comprising:

determining, using the controller, a projected stop position and a velocity of the elevator car; and determining, using the controller, an actual velocity of the elevator car when the projected stop position is not within a selected stop position range or the velocity is not within a selected velocity range.

4. An apparatus for operating an elevator system, the apparatus comprising:

a battery to power the elevator system when an external power source is unavailable;

an elevator car;

a drive unit;

a brake;

a controller to control a plurality of components of the elevator system, wherein controlling comprises operating at least one of the battery, the elevator car, the drive unit, and the brake, wherein the controller performs operations comprising:

determining a run profile of the elevator car in response to a selected deceleration;

operating the elevator car in response to the run profile determined;

determining an actual velocity of the elevator car; and adjusting the run profile to match the actual velocity when the actual velocity is less than a selected velocity.

5. The apparatus of claim 4, wherein the operations further comprise:

determining a projected stop position and a velocity of the elevator car; and commanding the brake to stop the elevator car when the projected stop position is within a selected stop position range and the velocity is within a selected velocity range.

6. The apparatus of claim 4, wherein the operations further comprise:

determining a projected stop position and a velocity of the elevator car; and determining an actual velocity of the elevator car when the projected stop position is not within a selected stop position range or the velocity is not within a selected velocity range.

* * * * *